US012662897B1

(12) United States Patent
Pye et al.

(10) Patent No.: US 12,662,897 B1
(45) Date of Patent: Jun. 23, 2026

(54) CASING ANNULUS CLEAN OUT AND REPAIR

(71) Applicant: Saudi Arabian Oil Company, Dhahran (SA)

(72) Inventors: Richard Mark Pye, Dhahran (SA); Rae Andrew Younger, Aberdeenshire (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/206,167

(22) Filed: May 13, 2025

(51) Int. Cl.

| | |
|---|---|
| ***E21B 33/14*** | (2006.01) |
| ***E21B 23/04*** | (2006.01) |
| ***E21B 36/00*** | (2006.01) |
| ***E21B 47/005*** | (2012.01) |

(52) U.S. Cl.
CPC ..... *E21B 33/14* (2013.01); *E21B 23/0413* (2020.05); *E21B 36/00* (2013.01); *E21B 47/005* (2020.05)

(58) Field of Classification Search
CPC ..... E21B 36/00
See application file for complete search history.

(56) References Cited

U.S. PATENT DOCUMENTS

| | | | | |
|---|---|---|---|---|
| 11,428,067 | B2 | 8/2022 | Carragher | |
| 11,434,716 | B2 | 9/2022 | Carragher et al. | |
| 11,634,963 | B2 | 4/2023 | Carragher et al. | |
| 11,753,897 | B2 | 9/2023 | Carragher et al. | |
| 2007/0137826 | A1* | 6/2007 | Bosma | E21B 36/00 166/380 |
| 2022/0018201 | A1 | 1/2022 | Bouldin et al. | |
| 2024/0141754 | A1* | 5/2024 | Mitchell | E21B 33/10 |

FOREIGN PATENT DOCUMENTS

| | | |
|---|---|---|
| EP | 3710671 B1 | 8/2022 |
| EP | 3631150 B1 | 11/2023 |
| GB | 2603562 A | 8/2022 |
| WO | WO 2018063829 A1 | 4/2018 |
| WO | WO 2022106848 A1 | 5/2022 |

* cited by examiner

*Primary Examiner* — William D Hutton, Jr.
*Assistant Examiner* — Avi T Skaist
(74) *Attorney, Agent, or Firm* — Dinmsore & Shohl LLP

(57) ABSTRACT

A well tool assembly for casing annulus clean out and repair includes an elongate, hollow tool body defining an internal volume. The tool body includes a heater section at a first end of the tool body. The heater section can receive a first heater in the internal volume. A pressure section is axially attached to the heater section. The pressure section defines multiple pressure ports on a circumferential surface of the tool body. The multiple pressure ports can flow fluid from the internal volume radially out of the tool body. An alloy section is axially attached to the pressure section. The alloy section carries a first quantity of alloy. The first heater can be positioned in the heater section and to heat and melt a second quantity of alloy. A second heater can be positioned in the alloy section and to heat and melt the first quantity of alloy.

20 Claims, 11 Drawing Sheets

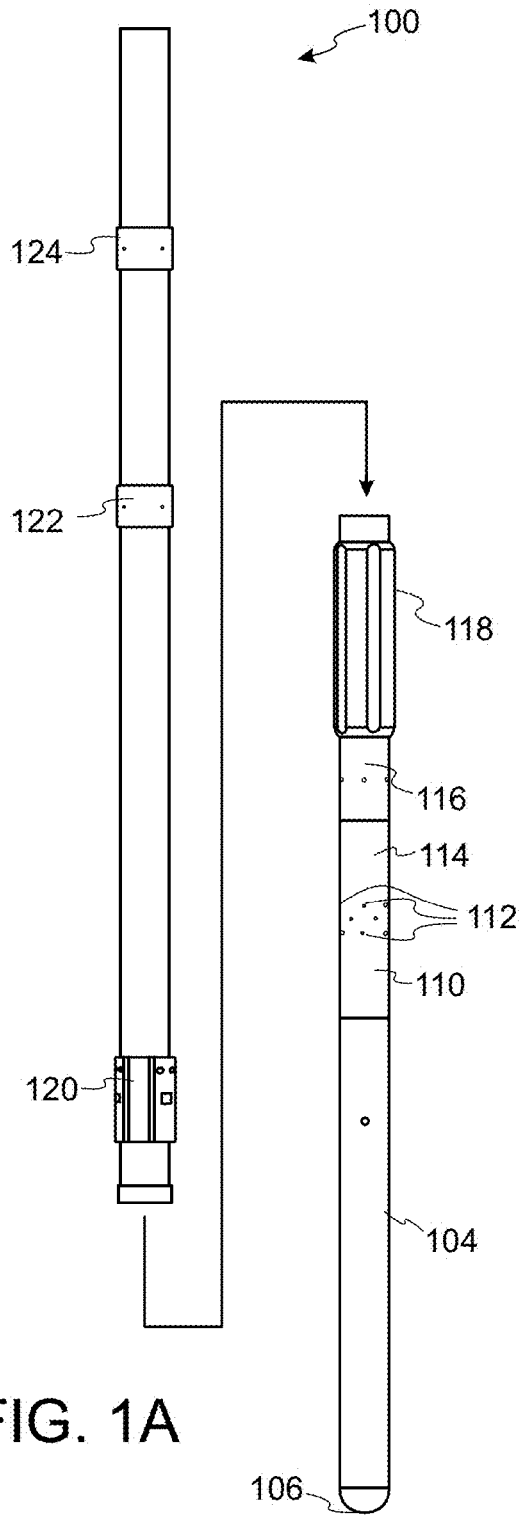
FIG. 1A
FIG. 1B
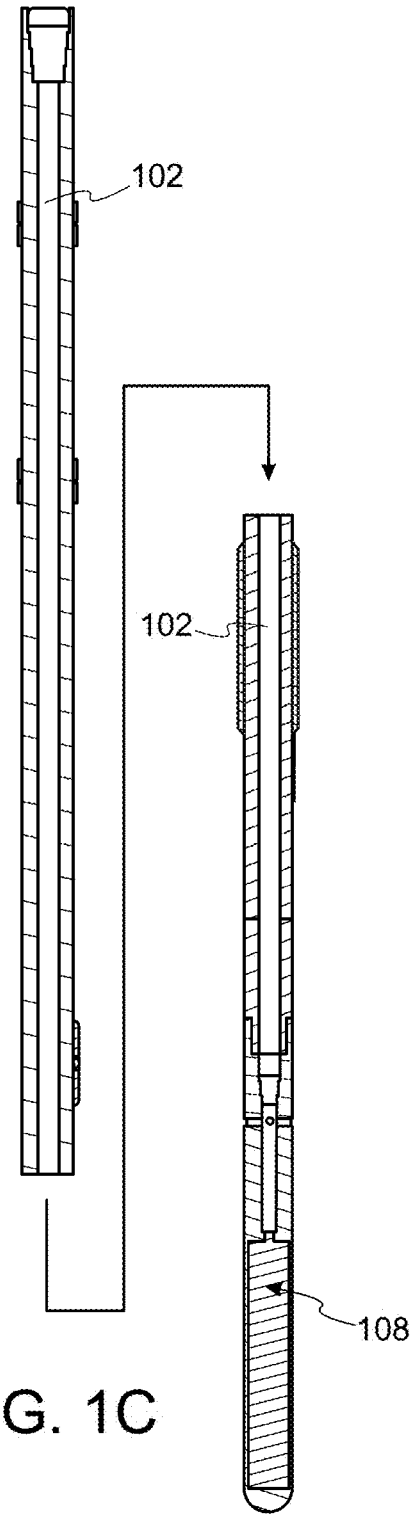
FIG. 1C
FIG. 1D

CASING ANNULUS CLEAN OUT AND REPAIR

TECHNICAL FIELD

This disclosure relates to wellbore operations, for example, operations performed when cleaning wellbores, specifically, wellbore annulus.

BACKGROUND

Well formation and operation involves drilling a wellbore from a surface of the Earth to subsurface reservoirs storing hydrocarbons, and installing a wellbore casing in the wellbore. A wellbore casing is a hollow pipe that lines the inside of the wellbore to support the well and protect the surrounding environment. When run into the wellbore, the outer surface of the casing and an inner wall of the wellbore define an annulus. To install the casing in the wellbore, the annulus can be filled with cement. Once cured, the cement structurally supports the wellbore.

Well formation can also involve installing multiple, separate lengths of wellbore casing in the wellbore. The outermost casing (i.e., the casing that runs to the surface of the well) has the largest diameter. Each inner casing has a smaller diameter than the casing within which the inner casing is installed. Each inner casing defines a respective annulus with the outer casing within which the inner casing is installed. Each such annulus can also be filled with cement to provide structural support to the inner casings. Over time, cement in the annulus can crack. Crack propagation can provide a path for hydrocarbons from the subsurface reservoirs to migrate through the path in the cracked cement in the annulus rather than through the well.

SUMMARY

This specification describes technologies relating to casing annulus clean out and repair.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIG. 1A is a schematic of a portion of a well tool body.

FIG. 1B is a schematic of another portion of the well tool body.

FIG. 1C is a schematic of a cross-section of the portion of the well tool body shown in FIG. 1A.

FIG. 1D is a schematic of a cross-section of the portion of the well tool body shown in FIG. 1B.

Like reference numbers and designations in the various drawings indicate like elements.

DETAILED DESCRIPTION

Figure 2B:
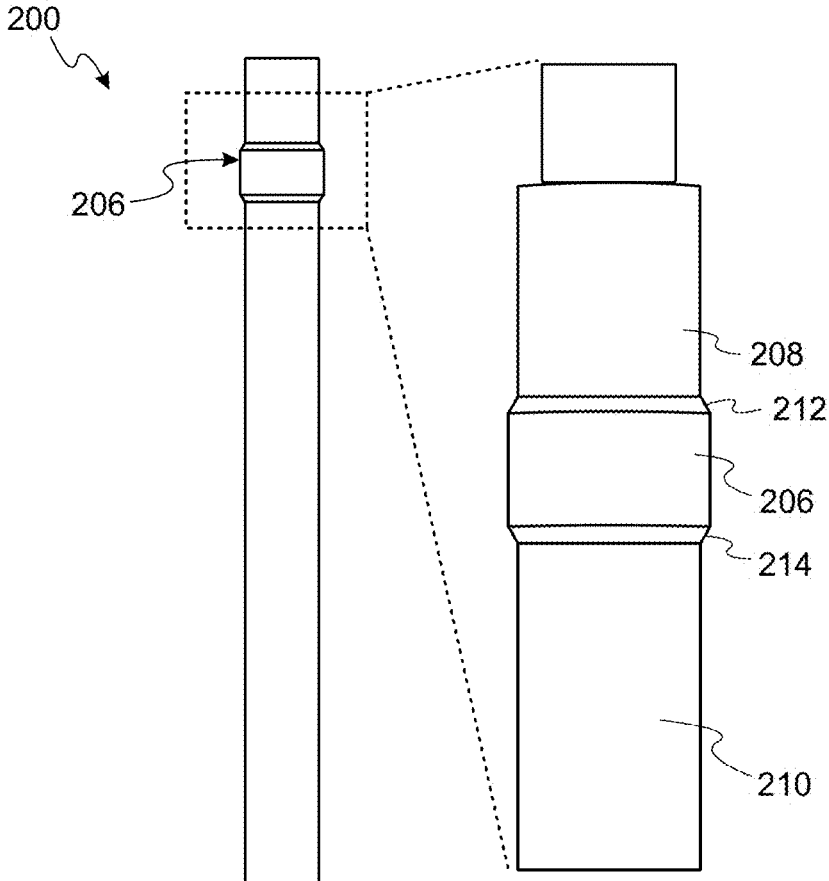
FIG. 2B is a schematic of a seat formed in the casing joint of FIG. 2A.

In well construction, steel casing is used to isolate the subterranean zone (i.e., a formation, a portion of a formation or multiple formations) through which the well is formed from the Earth to the subsurface reservoirs storing the hydrocarbons. The outermost casing (conductor casing) is first installed to form an annulus between the outer surface of the conductor casing and an inner surface of the subterranean zone (i.e., an inner wall of the wellbore). Casings of smaller diameter (e.g., surface casing, intermediate casing, production liner) are successively installed within the conductor casing. The reduced diameters allows each casing to pass through the casing that has been run before. The annulus defined by two casings is usually cemented (i.e., filled with cement) to anchor the casing and provide a barrier to gas and fluid migration between the casings. In particular, cement can be filled to cover the new casing, across an end of the previous casing (i.e., the casing shoe) and some additional distance or back to the surface.

Over time, cracks can form in the cement which can result in pressure building between the casings. The cracks can propagate to provide a path for gases from the subsurface reservoir to migrate to the surface through the annulus. In such instances, well operations may need to be suspended for safety reasons because produced hydrocarbons are supposed to flow only through the production tubing (i.e., the innermost conduit).

Fixing cracks in annular cement can be difficult because accessing the annular region with the cracked cement is difficult. For example, fixing the leak can require removing the production tubing from the well and breaching the casing around the region carrying the cracked cement. Breaching the casing may require milling across the zone in which the cracked cement resides, drilling holes in the casing or using tools such as mechanical punches or explosives. Such operations can be technically complex and result in well downtime.

This disclosure describes technologies relating to a well tool system that simplifies the process of sustained casing pressure (SCP) repairs in the annulus between two strings of wellbore casing. As described below, the well tool system is capable of opening ports in a casing to expose an annulus between an innermost casing of the well and a casing that immediately surrounds the innermost casing (called "A annulus" in some instances). In instances in which the wellbore includes only one casing, the well tool system can expose the annulus between the one casing and the inner wall of the wellbore. The well tool system can be implemented to clean out the annulus, e.g., to remove any cracked cement in the annulus, and to apply a metal alloy seal in the annulus to prevent fluid migration through the annulus.

FIG. 1A is a schematic of a portion of a well tool body. FIG. 1B is a schematic of another portion of the well tool body. FIG. 1C is a schematic of a cross-section of the portion of the well tool body shown in FIG. 1A. FIG. 1D is a schematic of a cross-section of the portion of the well tool body shown in FIG. 1B. As described below, the well tool body 100 is configured to be deployed into a wellbore formed from a surface of the Earth through a subterranean zone to a subsurface reservoir storing hydrocarbons. Specifically, the well tool body 100 can be run into a casing (described later) and, in a single trip, operated to set a metallic plug in the annulus between the casing into which the well tool body 100 is run and the immediately outer casing that surrounds that casing. For example, the well tool body 100 can be implemented to clear out cement in the annulus, thereby revealing a gap. The well tool body 100 can further be implemented to place a quantity of alloy material in the gap in place of the removed cement. In this manner, the well tool body 100 can perform casing annulus clean out and repair.

The well tool body 100 includes an elongate, hollow tool body that defines an internal volume 102 (FIG. 1C, FIG. 1D). The tool body can be made of material such as steel. The well tool body 100 includes a heater section 104 at a first end 106 of the well tool body 100. The heater section 104 can be a separate component that can be threaded into the end of the tool body 100. In some implementations, the first end 106 can be removable. In such implementations, the heater 108 can be a separate component that can be inserted into the heater section 106 upon removing an end cap at the first end 106. The first end 106 can be the downhole end of the well tool body 100, i.e., the end that is closer to the downhole end of the wellbore when the well tool body 100 is run into the wellbore. The heater section 104 can receive a first heater 108 in the internal volume 102 defined by the well tool body 100 at the heater section 104. The first heater 108 has an outer shape that compliments an inner shape defined by the internal volume 104 at the heater section 104. As described later, the first heater 108 is capable of melting a quantity of alloy when the first heater 108 is placed in the vicinity of the alloy. For example, the first heater 108 is a thermite heater, e.g., a composition of metal powder and metal oxide, that is capable of generating heat through an exothermic oxidation reduction (redox) reaction with a relatively slow burn without creating large volumes of gas. The material with which the heater section 104 is made can be capable of withstanding the heat generated by the heater section 104 to heat and melt a quantity of alloy (described below) without itself undergoing any structural change due to the generated heat. For example, the heater section 104 can be an extension of or be made with the same material as the tool body, e.g., steel. The steel can melt at a temperature of about 2000° C. while the alloy can melt at a temperature between 150° C. and 200° C.

The well tool body 100 includes a pressure section 110 axially attached to the heater section 104. The pressure section 110 and the heater section 108 can be threadedly connected to each other. The pressure section 110 can be reused in multiple instances of using the system described here. The pressure section 110 is a length of tubular that has the same inner/outer diameters as the heater section 104. The pressure section 110 includes multiple pressure ports 112 formed on a circumferential surface 114 of the pressure section 110. Each pressure port is a through hole on the wall of the pressure section 110. Each pressure port can be oriented to flow fluid in a radial direction relative to a longitudinal axis of the pressure section 110. The material with which the pressure section 110 is made can be capable of withstanding fluidic pressure generated when fluid is flowed from within the internal volume 102 through the multiple pressure ports 112. In some implementations, the shape of each pressure port can be formed to increase a flow velocity of fluid flowed radially outward through the pressure ports. In some implementations, nozzles (e.g., tungsten carbide nozzle or nozzle made of similar hard wearing material) can be deployed in one or more or all of the pressure ports to increase a flow velocity of fluid flowed through the pressure ports. In some implementations, the nozzles can be replaceable for better control and tool longevity.

The well tool body 100 includes a metallic sleeve 116 axially attached to the pressure section 110. The alloy section 116 carries a first quantity of alloy 118. Examples of the alloys include eutectic alloys and compositions made of two or more different materials such that the melting point of the alloy is less than the melting point of each individual component that makes up the alloy. The melting point of the alloy can be manipulated by adjusting the ratios of the individual components. The components can include, for example, bismuth and tin. Bismuth alloy expands on solidification, making the alloy ideal to provide a good seal. The quantity of alloy is bonded to the metallic sleeve, e.g., during manufacture of the metallic sleeve 116. The metallic sleeve 116 is attached to the well tool body 100, specifically to the pressure section 110 using shear screws. A quantity of the alloy 118 on the metallic sleeve 116 depends on the quantity of cement to be cleared out from the annulus. The first quantity of alloy 118 can be a solid ingot formed as a sleeve and disposed around an outer surface of the tubular that forms the alloy section 116. The sleeve can be secured to the well tool body 110 by shearable pins (not shown). As described later, the alloy section 116 can receive a second heater (described later) in the internal volume 102 defined by the well tool body 100 at the alloy section 116. The second heater has an outer shape that compliments an inner shape defined by the internal volume 102 at the alloy section 116. As described later, the second heater is capable of melting the first quantity of alloy 118 when the second heater is placed in the vicinity of the alloy 118. The material with which the alloy section 116 is made can be capable of withstanding the heat generated by the second heater to heat and melt the quantity of alloy 18 without itself undergoing any structural change due to the generated heat. For example, the alloy section 116 can be an extension of or be made with the same material as the tool body, e.g., steel.

Figure 2A:
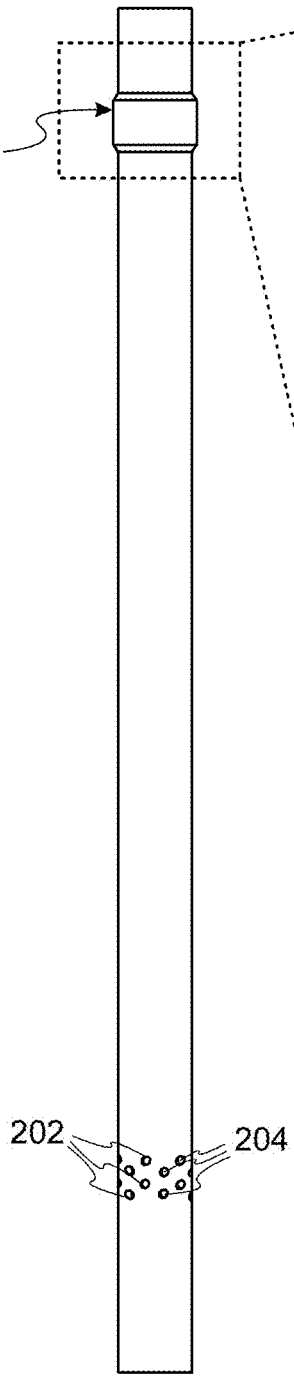
FIG. 2A is a schematic of a casing joint within which the well tool body is run.
Figure 2C:
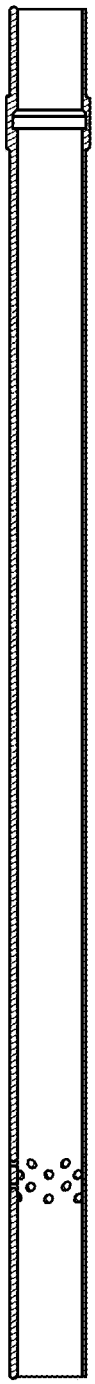
FIG. 2C is a schematic of cross-sectional view of the casing joint of FIG. 2A.

FIG. 2A is a schematic of a casing joint within which the well tool body is run. FIG. 2B is a schematic of a seat formed in the casing joint of FIG. 2A. FIG. 2C is a schematic of cross-sectional view of the casing joint of FIG. 2A. The well tool system includes a casing joint 200 that can be installed within a wellbore (not shown). The casing joint 200 is an elongate tubular having an inner diameter larger than an outer diameter of the well tool body 100 (FIGS. 1A-1D). The casing joint 200 can be a length of tubular that can be axially attached to other casing joints that collectively make up the casing. In operation, the casing joint 200 is first installed within the wellbore, e.g., within another casing joint. The casing joint 200 can define an annulus with another casing joint within which the casing joint 200 is installed or with an inner wall of the wellbore itself. The annulus surrounding the casing joint 200 can be cemented, i.e., filled with cement.

The casing joint 200 can include multiple alloy ports 202. Each port is a through hole on the wall of the casing joint 200. Each port carries a quantity of alloy 204, (FIGS. 1A-1D). When the well tool body 100 (FIGS. 1A-1D) is run into the casing joint 200, the first heater 108 (FIGS. 1A-1D) is positioned radially adjacent to, e.g., at the same well depth as, the multiple alloy ports 202. When the first heater 108 is switched on as described later, heat from the first heater 108 can melt the alloy 204 in the alloy ports 202. The melted alloy 204 flows out of the multiple alloy ports 202, thereby exposing the through holes that define the ports. As described later, the well tool body 100 can be run further into the casing joint 200 to first align the pressure section 110 and then align the alloy section 116 with the exposed through holes.

The casing joint 200 defines a seat 206 that is configured to receive the well tool body 100 when the well tool body 100 is run into the casing joint 200. The seat 206 engages the well tool body 100 to lock or secure the well tool body 100 from axial movement of the well tool body 100 through the casing joint 200. FIG. 2B shows an outer surface of the seat 206. On either side of the seat 206 are a first casing joint section 208 and a second casing joint section 210, each having the same outer and inner diameters as the rest of the casing joint 200. The seat 206 joins the first casing joint section 208 and the second casing joint section 210 at respective shoulders (212, 214). The seat 206 itself has a larger outer diameter than the outer diameter of the casing joint 200, specifically, than the outer diameters of the first casing joint section 208 and the second casing joint section 210. Within the casing joint 200, the seat 206 includes a recessed portion having an inner diameter that is greater than an inner diameter of the casing joint 200, specifically, than the inner diameters of the first casing joint 208 and the second casing joint 210.

Returning to FIGS. 1A-1D, the well tool body 100 includes a landing collar 120 on an outer surface of the well tool body 100, axially offset from the heater section 104. When the well tool body 100 is run into the casing joint 200 (FIGS. 2A-2C), the landing collar 120 is uphole of the heater section 104.

Figure 3A:
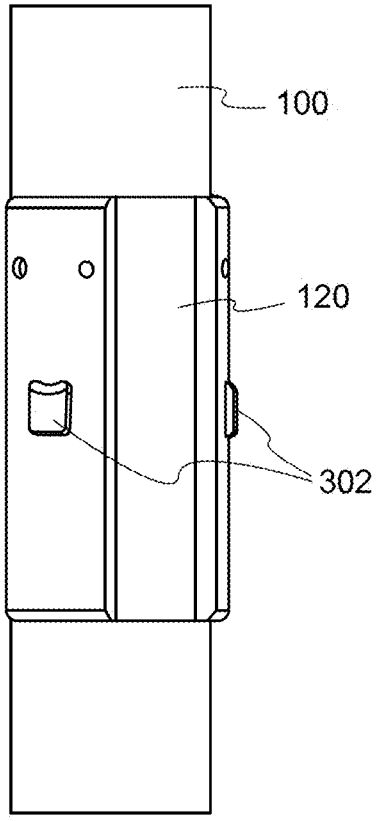
FIG. 3A is a schematic of a landing collar.
Figure 3B:
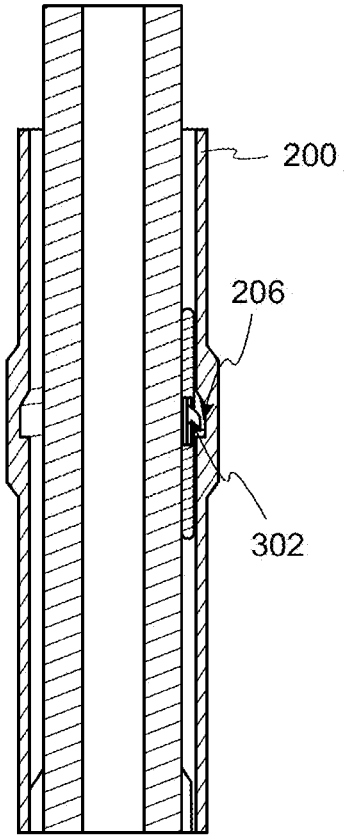
FIG. 3B is a schematic of a cross-sectional view of the landing collar of FIG. 3A.

FIG. 3A is a schematic of the landing collar 120. FIG. 3B is a schematic of a cross-sectional view of the landing collar 120. The landing collar 120 is a sleeve attached to an outer surface of the well tool body 100. The landing collar 120 includes landing collar dogs 302, which protrude radially away from an outer surface of the landing collar 120. For example, the landing collar 120 can include three dogs 302, up to six dogs or more. The dogs 302 are spring-loaded and connected to the well tool body 100 by shearable pins (not shown). The springs are radially compressed when the well tool body 100 is run into the casing joint 200. When the landing collar 120 reaches the seat 206 that has a larger inner diameter than that of the casing joint 200, the springs of the dogs 302 de-compress extending the dogs 302 radially outward into the seat 206. The outer edge of the dogs 302 has a profile that locks into the seat 306, thereby preventing further axial movement of the well tool body 100 within the casing joint 200. The distance between the landing collar 120 and the heater section 104 is selected such that when the landing collar 120 is received by the seat 206, the heater section 104 resides radially adjacent to, i.e., at the same well depth as, the multiple alloy ports 202.

Returning to FIGS. 1A-1D, the well tool body 100 includes a first stop collar 122 on an outer surface of the well tool body 110, axially offset from the pressure section 110 and from the landing collar 120. After the landing collar 120 is received in the seat 206, when the well tool body 100 is further run into the casing joint 200 (FIGS. 2A-2C), the first stop collar 122 is uphole of the pressure section 110 and the landing collar 120. The first stop collar 122 is a ring of material with no moving parts. The outer diameter of the first stop collar 122 is similar to that of the landing collar 120. The first stop collar 122 is held to the tool body 100 with shear pins. The distance between the first stop collar 122 and the pressure section 110 is selected such that when the first stop collar 122 is in position abutted to the landing collar 120 the pressure section 110 resides radially adjacent to, i.e., at the same well depth as, the multiple alloy ports 202 after the heater 108 in the heater section 104 has melted the quantity of alloy in the multiple alloy ports 202.

The well tool body 100 includes a second stop collar 124 on an outer surface of the well tool body 110, axially offset from the alloy section 16 and the first stop collar 122. The distance between the second stop collar 124 and the alloy section 116 is selected such that when the second stop collar 124 is in position abutted to the first stop collar 122, the alloy section 116 resides radially adjacent to, i.e., at the same well depth as, the multiple alloy ports 202 after the heater 108 in the heater section 104 has melted the quantity of alloy in the multiple alloy ports 202 and fluid has been flowed through the multiple ports 112 in the pressure section to clean out the annulus surrounding the casing joint 200.

Figure 4A:
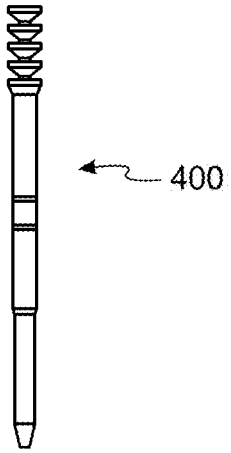
FIG. 4A is a schematic of an activation dart.
Figure 4B:
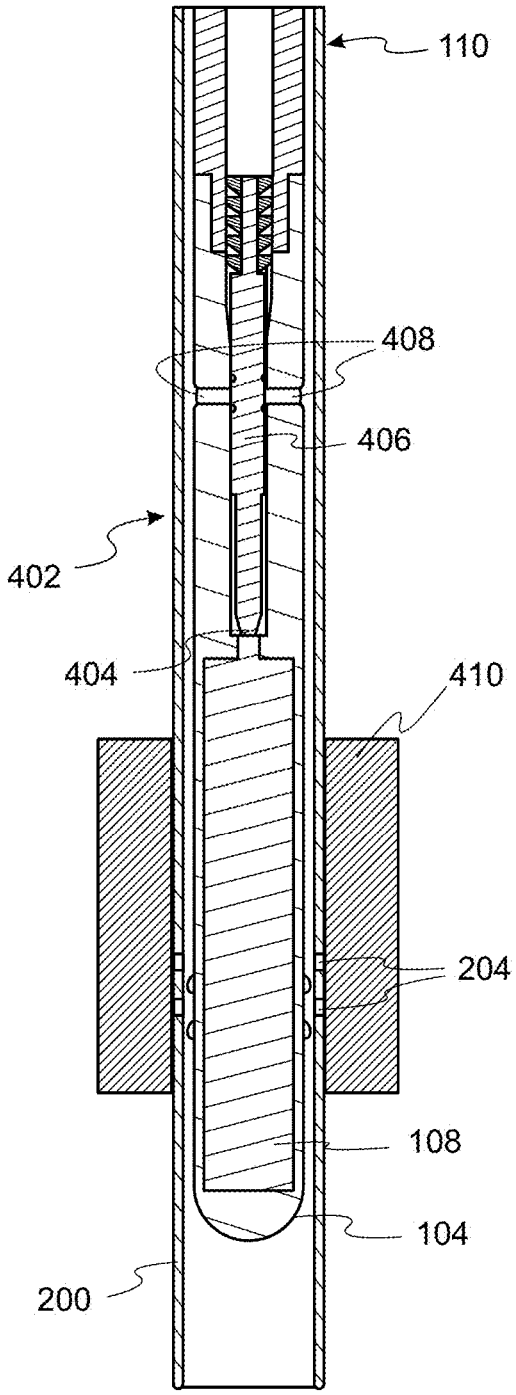
FIG. 4B is a schematic of a cross-sectional view of the well tool body to receive the activation dart of FIG. 4A.

FIG. 4A is a schematic of an activation dart. FIG. 4B is a schematic of a cross-sectional view of the well tool body to receive the activation dart of FIG. 4A. The well tool system includes an activation dart 400 that can be dropped into the well tool body 100. The outer diameter of the activation dart 400 is smaller than an inner diameter of the well tool body 100 above the heater section 104, allowing the activation dart 400 to travel through the well tool body 100. The activation dart 400 is received in a portion 402 of the well tool body 100 that resides between the heater section 104 and the pressure section 110. The portion 402 defines a seat 404 adjacent the heater section 104. When the dart 400 is dropped within the well tool body 100, an end of the activation dart 400 lands in the seat 404 and contacts the first heater 108 in the heater section 104, thereby turning on the first heater 108. The portion 402 also defines an inner profile 406 that matches an outer profile of the dart 400 such that when the dart 400 is received in the seat 404, the outer profile and the inner profile form a seal that prevents fluid flow from the pressure section 110 to the heater section 106. In addition, the portion 402 defines circulation ports 406 from within the well tool body 100 to the internal volume of the casing joint 200. The circulation ports 406 allow fluid flow through the well tool body 100 when the activation dart 400 is pumped through the well tool body 100 towards the portion 402. When the activation dart 400 is received in the seat 404, the activation dart 400 seals the circulation ports 406.

FIG. 4B schematically shows cement 410 that surrounds the annulus around the casing joint 200. The heater section 104 is radially adjacent the cement 410, and the first heater 108 resides radially adjacent the alloy 204 carried in the multiple alloy ports 202. In this arrangement, the landing collar 120 (FIGS. 1A-1D) is securedly seated in the seat 206 (FIGS. 2A-2C). The activation dart 400, once dropped onto the seat 404, turns on the heater 108. For example, the heater 108 includes a battery that generates a spark to initiate a reaction. The activation dart 400 lands on a switch to generate the spark. Once sparked, the reaction is self-sustaining. Alternatively, the activation dart 400 can set off a small percussion charge to ignire the heater 108. Heat generated by the heater 108 melts the alloy 204 exposing the ports 202 that carried the alloy.

Figures 5A, 5B:
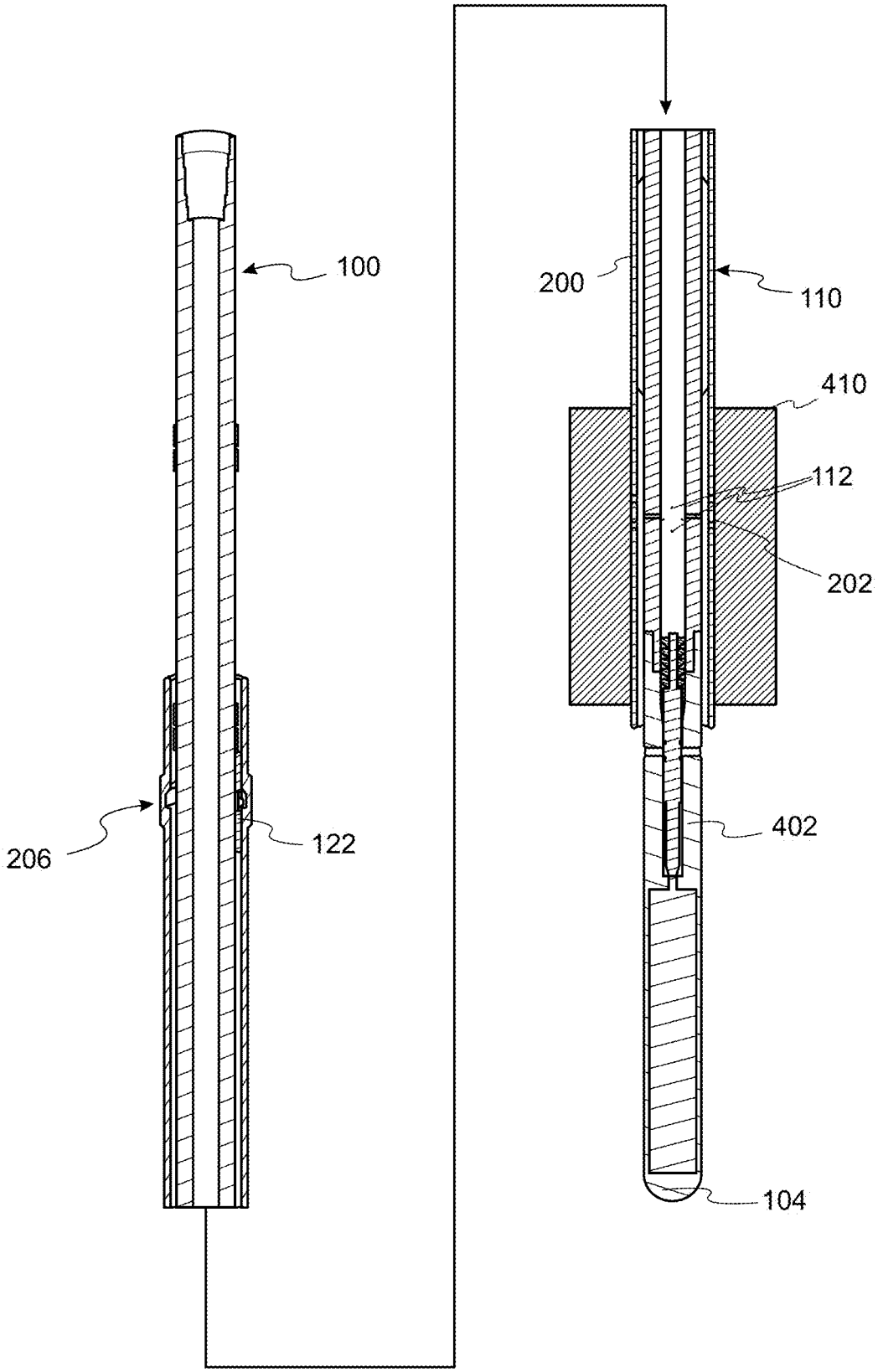
FIGS. 5A and 5B are schematics each of a cross-sectional view of the well tool body with the pressure section radially adjacent the annular cement.

FIGS. 5A and 5B are schematics each of a cross-sectional view of the well tool body with the pressure section radially adjacent the annular cement. The activation dart 400 is shown within the portion 402. After the heater 108 in the heater section 104 has melted the alloy 204 to expose the ports 202, the well tool body 100 is driven axially downward. The load is applied to the pins that secure the landing collar 120 to the well tool body 100. The well tool body 100 travels axially downward through the landing collar 120 which remains in the seat 206 in the casing joint 200. The stop collar 122 lands on the landing collar 120 and the pressure section 110 is now radially adjacent the exposed ports 202. In particular, the multiple pressure ports 112 of the pressure section 110 are radially adjacent the exposed ports 202. Axial travel of the well tool body 100 is limited/stopped by the engagement between the first stop collar 122 and the landing collar 120. In this arrangement, the multiple pressure ports 112 are at the same depth as the cement 410 in the annulus surrounding the casing joint 200.

Figure 6A:
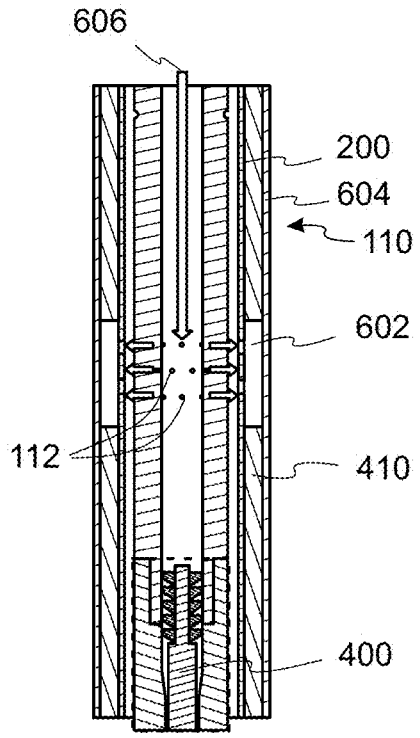
FIGS. 6A and 6B are schematics each of a cross-sectional view and a perspective view, respectively, of the well tool body with the pressure section radially adjacent the annular cement.
Figure 6B:
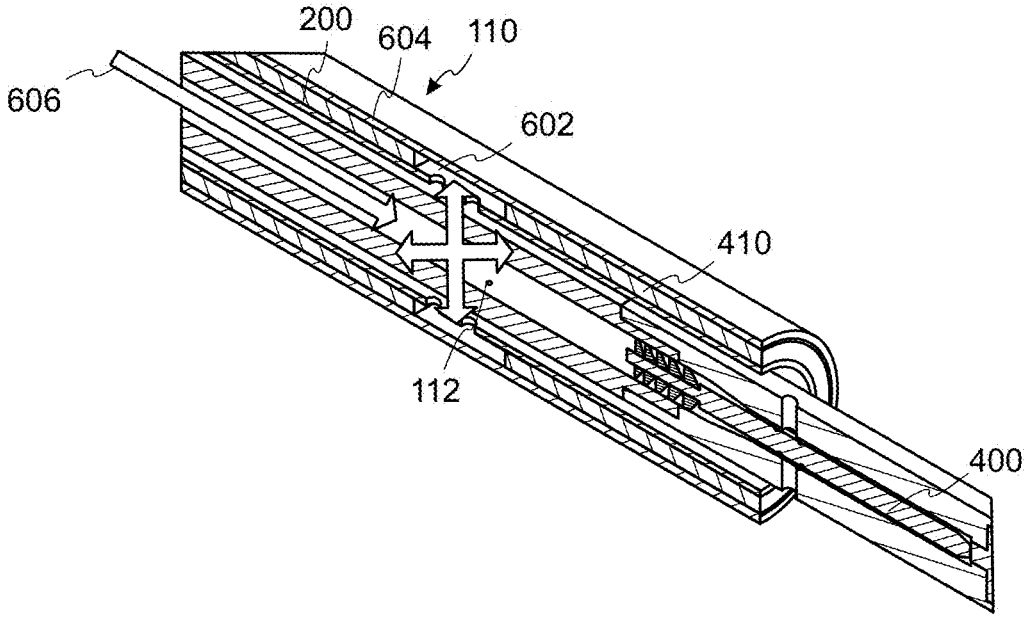

FIGS. 6A and 6B are schematics each of a cross-sectional view and a perspective view, respectively, of the well tool body with the pressure section 110 radially adjacent the annular cement 410, which surrounds the casing joint 200. In the schematic shown, the casing joint 200 is cemented within another casing 604. The multiple pressure ports 112 are aligned with the exposed ports 202 of the casing joint 200. Fluid is flowed (as represented by the arrow 606) axially downward from the surface towards the multiple pressure ports 112. As explained earlier, the activation dart 400 has formed a seal downhole of the pressure section 110, thereby forcing the fluid into through the multiple pressure ports 112 and radially onto the cement 410. The fluid impinges and removes portions of the cement 410 leaving gaps 602 around the casing joint 200. Examples of fluids suitable for this purpose include drilling fluid with a water or oil base or a brine. Chemicals that can dissolve cement can be added to such fluids to remove cement. Cement removed to form the gaps 602 are removed from the annulus by flowing the fluid back to the surface in an annulus between the casing joint 200 and the well tool body 100.

Figure 7A:
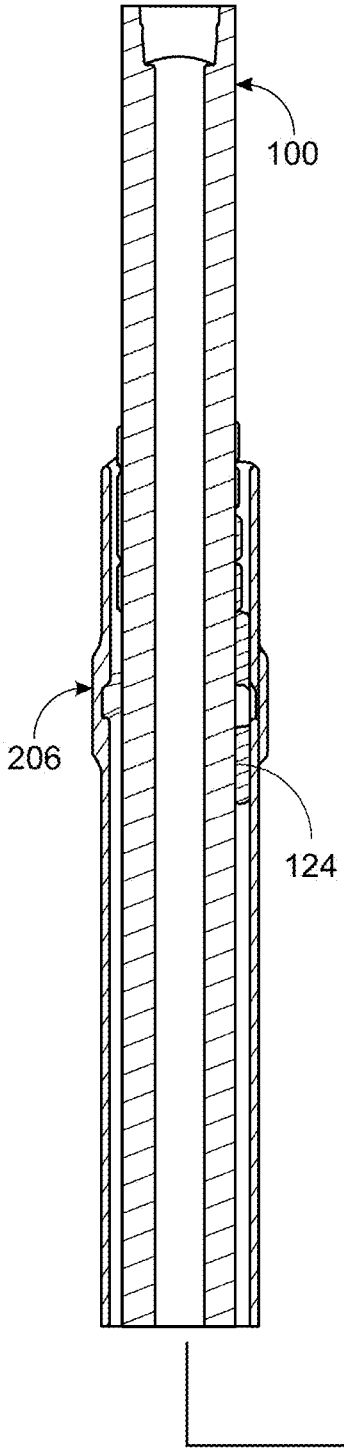
FIGS. 7A and 7B are schematics each of a cross-sectional view of the well tool body with the alloy section radially adjacent the annular cement.
Figure 7B:
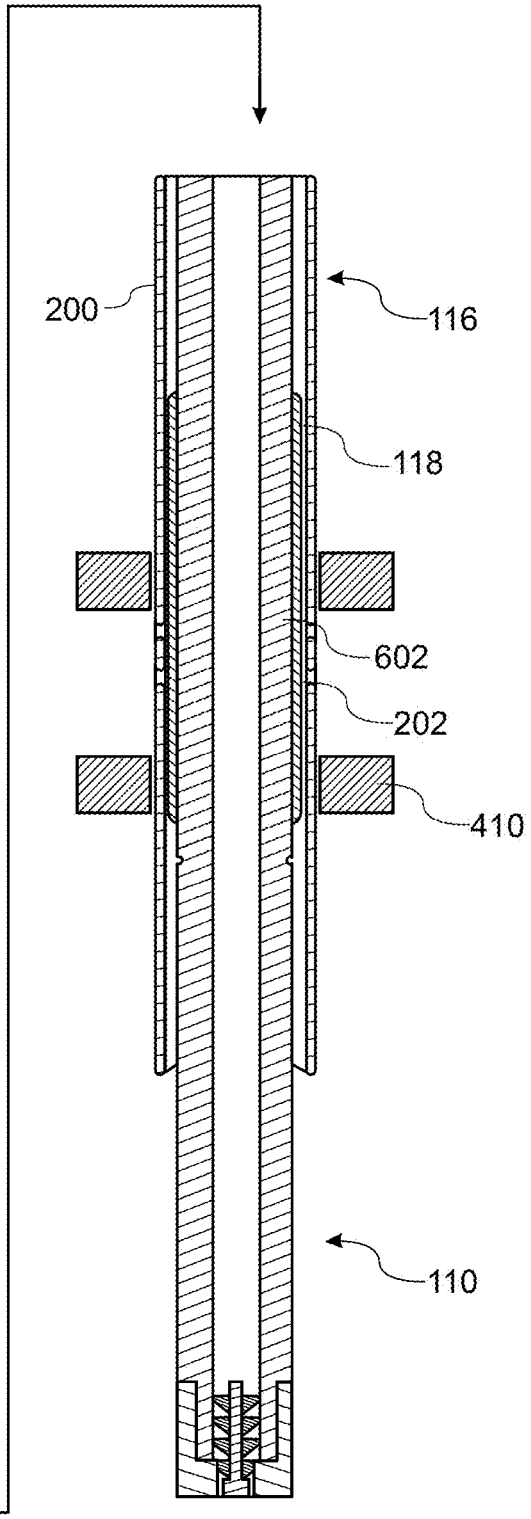

FIGS. 7A and 7B are schematics each of a cross-sectional view of the well tool body with the alloy section radially adjacent the annular cement. After the fluid has been flowed through the multiple pressure ports 112 to remove cement 410 and form the gaps 602, the well tool body 100 is driven axially downward by applying weight to the string. Pins shear in the first stop collar 122 and the Tool 100 slides through until the second stop collar 124 reaches the first stop collar 122 which remains on top of the landing collar 120 which in turn remains in the seat 206 in the casing joint 200. The stop collar 124 positions the alloy section 116 radially adjacent the exposed ports 202. In particular, the multiple pressure ports 112 of the pressure section 110 are radially adjacent the exposed ports 202.

Figure 8A:
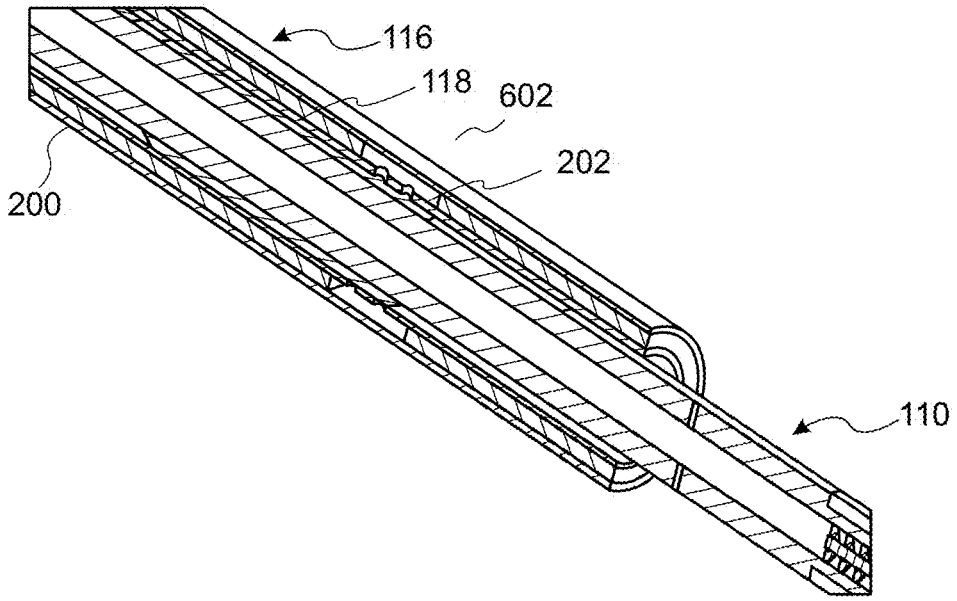
FIG. 8A is a schematic of a perspective view of the well tool body with the alloy section radially adjacent the annular cement.
Figure 8B:
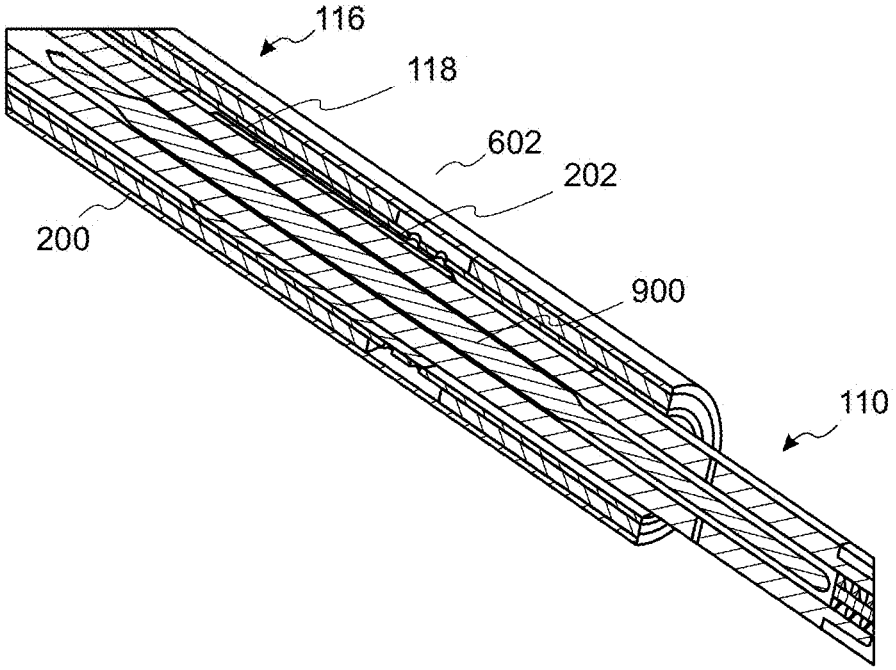
FIG. 8B is a schematic diagram of a heater positioned within the alloy section.
Figure 9:
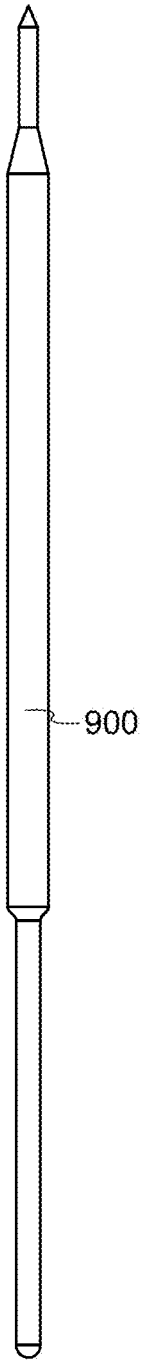
FIG. 9 is a schematic diagram of the heater positioned within the alloy section.

FIG. 8A is a schematic of a perspective view of the well tool body with the alloy section radially adjacent the annular cement. FIG. 8B is a schematic diagram of a heater 900 positioned within the alloy section. FIG. 9 is a schematic diagram of the heater positioned within the alloy section. After the first quantity of alloy 118 has been positioned radially adjacent the gap 602, the alloy can be used to fill the gap 602. To do so, a heater 900 (FIG. 9) is lowered through the internal volume of the well tool body 100, e.g., using a wireline or coiled tubing with e-line capability. The heater 900 and the internal volume of the alloy section 116 have complementary shapes such that the former is sized to fit within the latter. The length of the heater 900 is selected such that the heater 900 rests on the activation dart 400 while being radially adjacent to the exposed ports 202 and the gap 602 in the cement 410. The heater 900 can be powered through the wireline or e-line coupled coiled tubing to generate heat to melt the quantity of alloy 118. Additionally the heater could also be a thermite heater where ignition is activated electrically using a battery with a timer or directly from surface through the wireline cable.

The heater 900 is configured to heat the quantity of alloy 118 such that the alloy melts and flows substantially radially outward towards and into the gap 602. For example, the heater 900 can generate heat from the bottom up at a controlled rate. The alloy section 116 can be in a near vertical orientation. Some portion of the melted alloy falls vertically downward while a majority of the melted alloy flows radially outward into the gap 602. Some portion of the melted alloy also flows into the annulus between the well tool body 100 and the casing joint 200 forcing fluid in this annulus upward and outward.

Figure 10:
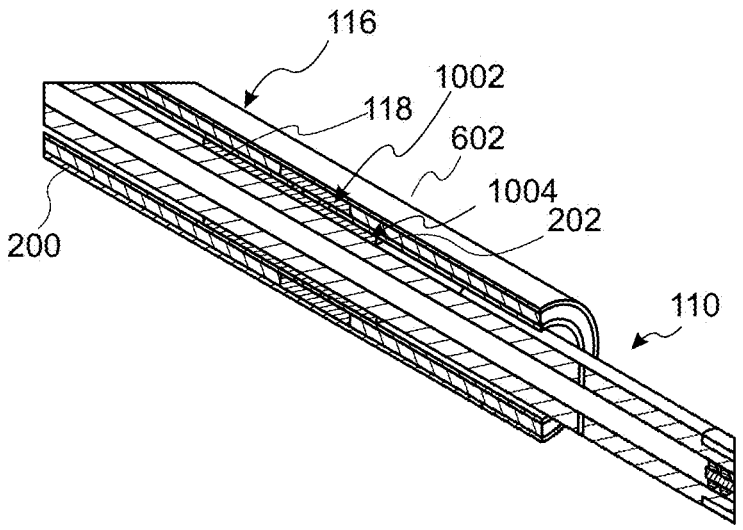
FIG. 10 is a schematic of a perspective view of the gap filled with melted alloy.
Figure 11:
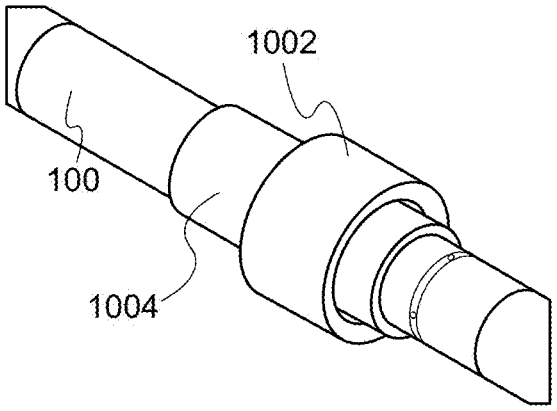
FIG. 11 is a schematic of a perspective view of the melted alloy surrounding the well tool body.

FIG. 10 is a schematic of a perspective view of the gap filled with melted alloy. FIG. 11 is a schematic of a perspective view of the melted alloy surrounding the well tool body. As schematically shown in FIG. 10, some alloy portions 1002 fill the gap 602 formed by cement removal, thereby sealing the gap. Some alloy portions 1004 form a plug in the annulus between the well tool body 100 and the casing joint 200. In particular, the alloy portions 1004 form a plug around the alloy section 116 of the well tool body 100. In some implementations, the alloy portions 1002 and the alloy portions 1004 form two toroids of different diameter. The heater 900 can be removed from within the alloy section 116, e.g., by raising the wireline or coiled tubing to the surface.

Figure 12:
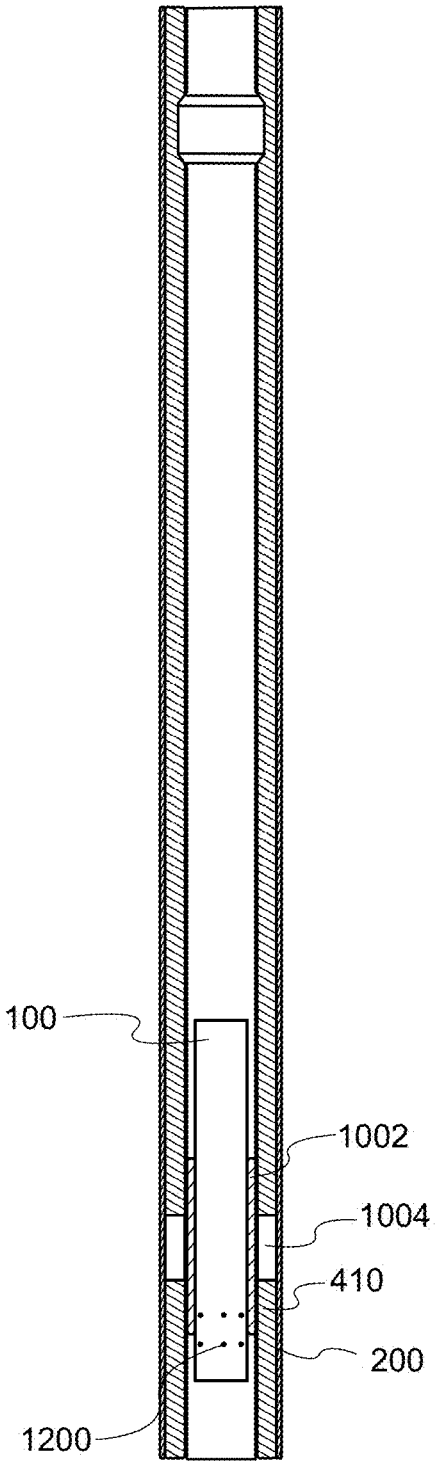
FIG. 12 is a schematic of a cross-section of the casing joint from which the well tool body is removed.

FIG. 12 is a schematic of a cross-section of the casing joint from which the well tool body is removed. As explained above, the first quantity of alloy 118 can be a solid ingot formed on a sleeve and disposed around an outer surface of the tubular that forms the alloy section 116. The sleeve can be secured to the well tool body 110 by shearable pins 1200. The pins 1200 can be of a material that is not structurally affected by the heat generated by the heater 900 to melt the alloy 118. Also, as explained above, the melted alloy forms some alloy portions 1002 in the annulus between the casing joint 200 and the well tool body 100, and some alloy portions 1004 in the annulus surrounding the casing joint 200. To remove the well tool body 100, an uphole force can be applied on the well tool body 100. Upon application of sufficient force, the pins 1200 can shear freeing the well tool body 100 from the alloy portions 1002 and 1004. The well tool body 100 can then be drawn to the surface. The alloy portions 1002 can then be drilled through to access portions of the well below.

Figure 13:
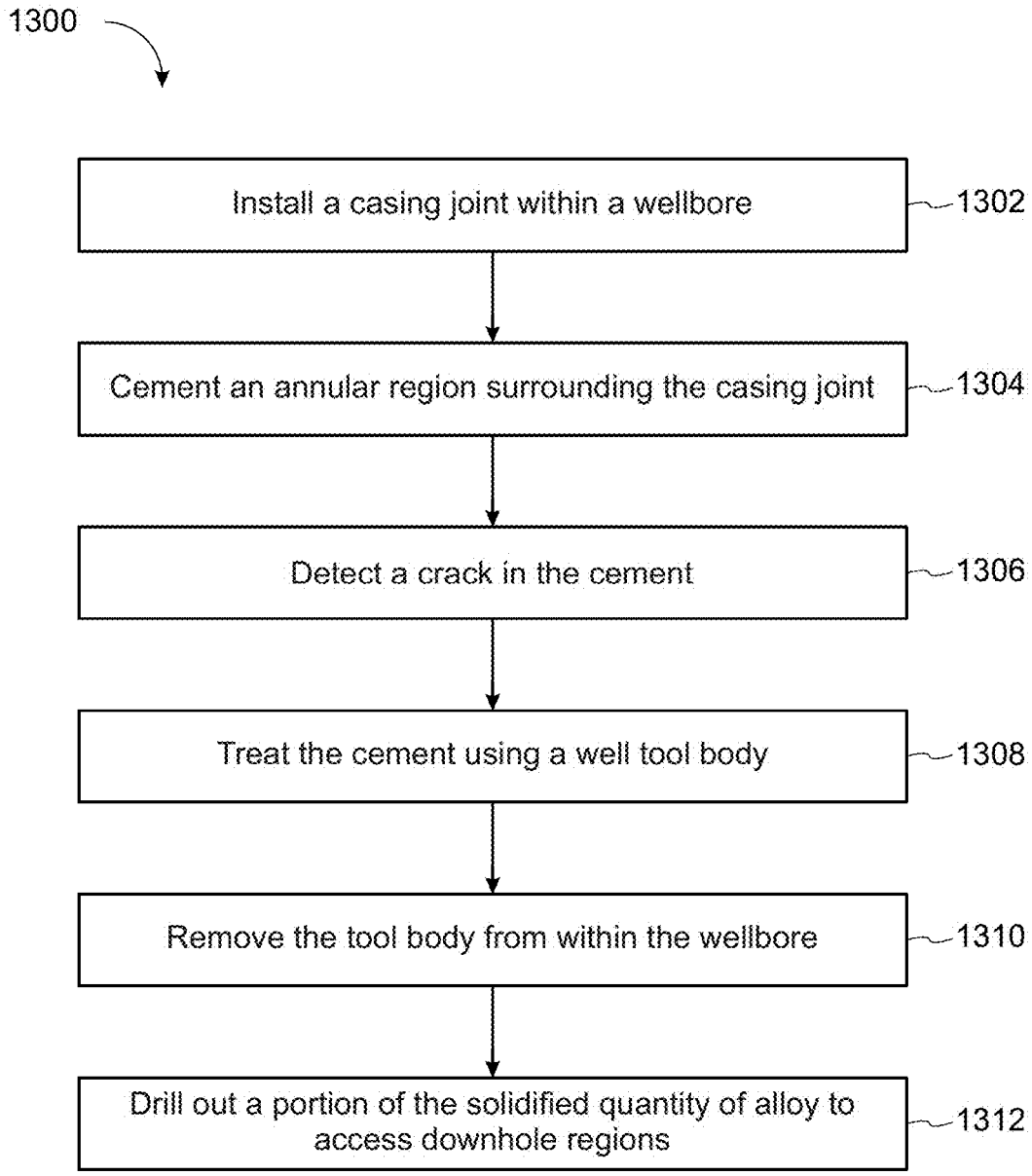
FIG. 13 is a flowchart of an example of a process of treating cement in a casing-to-casing annulus.

FIG. 13 is a flowchart of an example of a process 1300 of treating cement in a casing-to-casing annulus. At 1302, a casing joint (e.g., the casing joint 200) is installed within a wellbore. The casing joint is installed at some location above a casing shoe of a previously installed casing. At 1304, an annular region surrounding the casing joint is cemented. In implementations in which the casing joint is installed within another casing, the cement is filled in the casing-to-casing annulus. In some implementations, multiple casing joints, each similar to the casing joint 200, can be run into and installed within the wellbore. Such installation allows treating cement at different depths within the wellbore.

At 1306, a crack in the cement is detected. Such a crack can be detected by detecting that hydrocarbons at flowing to the surface through the annulus. Flow through the annulus indicates the presence of a pathway in the cement. Such pathway is the result of a crack in the cement with the point of entry often being at the casing shoe. At 1308, the cement is treated using the well tool body 100 by implementing the operations described above with reference to FIGS. 1-12. At 1310, the tool body is removed from within the wellbore after treating the crack by deploying quantities of alloy in the casing-to-casing annulus. At 1312, a portion of the alloy is drilled out to access downhole regions.

EXAMPLES

Certain aspects of the subject matter described here can be implemented as a well tool assembly. The assembly includes an elongate, hollow tool body defining an internal volume. The tool body includes a heater section at a first end of the tool body. The heater section is configured to receive a first heater in the internal volume. A pressure section is axially attached to the heater section. The pressure section defines multiple pressure ports on a circumferential surface of the tool body. The multiple pressure ports can flow fluid from the internal volume radially out of the tool body. An alloy section is axially attached to the pressure section. The alloy section carries a first quantity of alloy. The first heater is configured to be positioned in the heater section and to heat and melt a second quantity of alloy. A second heater is configured to be positioned in the alloy section and to heat and melt the first quantity of alloy.

An aspect combinable with any other aspect includes the following features. A casing joint is configured to be installed within a wellbore. The casing joint includes multiple alloy ports carrying the second quantity of alloy. The first heater is configured to heat and melt the second quantity of alloy.

An aspect combinable with any other aspect includes the following features. The tool body includes a landing collar that is axially offset from the heater section. The landing collar is configured to cause the heater section to reside radially adjacent the multiple alloy ports in response to the tool body being installed within the casing joint.

An aspect combinable with any other aspect includes the following features. The tool body includes a first stop collar that is axially offset from the pressure section. The first stop collar is configured to cause the heater section to travel axially until the pressure section resides radially adjacent the multiple alloy ports after the first heater has heated and melted the second quantity of alloy.

An aspect combinable with any other aspect includes the following features. The tool body includes a second stop collar that is axially offset from the alloy section. The second stop collar is configured to cause the pressure section to travel axially until the alloy section resides radially adjacent the multiple alloy ports after the fluid has flowed through the multiple pressure ports radially out of the tool body.

An aspect combinable with any other aspect includes the following features. The casing joint defines a seat configured to receive the landing collar when the tool body is installed within the casing joint.

An aspect combinable with any other aspect includes the following features. An activation dart is configured to be dropped into the tool body. The activation dart is configured to land in a seat adjacent the heater section and to turn on the first heater.

An aspect combinable with any other aspect includes the following features. The tool body defines circulation ports on the circumferential surface of the tool body between the heater section and the pressure section. The activation dart closes the circulation ports and causes the fluid to flow through the multiple pressure ports.

An aspect combinable with any other aspect includes the following features. An inner profile of the pressure section substantially matches an outer profile of the activation dart. The activation dart is configured to axially seal the pressure section.

Certain aspects of the subject matter described here can be implemented as a method. A tool body defining an internal volume is run within a casing joint installed within a wellbore. The casing joint includes multiple alloy ports carrying a quantity of alloy. A heater section is positioned at a first end of the tool body radially adjacent the multiple alloy ports. The heater section carries a first heater. The first heater is operated to heat and melt the quantity of alloy in the multiple alloy ports exposing an annular region between an outer surface of the casing joint and an inner wall of the wellbore. After operating the first heater to heat and melt the quantity of alloy, a pressure section, which is axially attached to the heater section, is positioned radially adjacent the multiple alloy ports. The pressure section defines multiple pressure ports on a circumferential surface of the tool body. Through the multiple pressure ports, fluid is flowed from the internal volume of the tool body and through the multiple alloy ports into the annular region. After flowing the fluid into the annular region, an alloy section, which is axially attached to the pressure section, is positioned radially adjacent the multiple alloy ports. The alloy section carries a quantity of alloy. The quantity of alloy carried by the alloy section is heated, causing the quantity of alloy to melt and flow into the annular region.

An aspect combinable with any other aspect includes the following features. To manufacture the casing joint, the multiple alloy ports are formed in the casing joint. The quantity of alloy is deposited in the multiple alloy ports.

An aspect combinable with any other aspect includes the following features. When manufacturing the casing joint, a seat is formed in the casing joint at a location that is axially offset from the multiple alloy ports.

An aspect combinable with any other aspect includes the following features. The tool body includes a landing collar that is axially offset from the heater section. To position the heater section at the first end of the tool body radially adjacent the multiple alloy ports, the tool body is run within the casing joint until the landing collar is received in the seat.

An aspect combinable with any other aspect includes the following features. The tool body includes a first stop collar that is axially offset from the pressure section. To position the pressure section radially adjacent the multiple alloy ports, the tool body is run within the casing joint until the first stop collar abuts the landing collar.

An aspect combinable with any other aspect includes the following features. The tool body includes a second stop collar that is axially offset from the alloy section. To position the alloy section radially adjacent the multiple alloy ports, the tool body is run within the casing joint until the second stop collar abuts the first stop collar.

An aspect combinable with any other aspect includes the following features. To operate the first heater to heat and melt the quantity of alloy in the multiple alloy ports, an activation dart is dropped into the tool body. The activation dart lands in a seat adjacent the heater section to turn on the first heater.

An aspect combinable with any other aspect includes the following features. In response to being dropped into the tool body, the activation dart closes circulation ports defined on the circumferential surface of the tool body between the heater section and the pressure section. In response to the activation dart closing the circulation ports, the fluid flows through the multiple pressure ports.

An aspect combinable with any other aspect includes the following features. The quantity of alloy, after melting and flowing into the annular region, solidifies. After the quantity of alloy solidifies, the tool body is withdrawn from within the wellbore. A portion of the solidified quantity of alloy is drilled out to access downhole regions within the wellbore.

Thus, particular implementations of the subject matter have been described. Other implementations are within the scope of the following claims.

The invention claimed is:

1. A well tool assembly, comprising:

an elongate, hollow tool body defining an internal volume, the tool body comprising:

a heater section at a first end of the tool body, the heater section configured to receive a first heater in the internal volume;

a pressure section axially attached to the heater section, the pressure section defining a plurality of pressure ports on a circumferential surface of the tool body, the plurality of pressure ports configured to flow the fluid from the internal volume radially out of the tool body; and an alloy section axially attached to the pressure section, the alloy section carrying a first quantity of alloy;

the first heater configured to be positioned in the heater section, the first heater configured to heat and melt a second quantity of alloy;

a second heater configured to be positioned in the alloy section, the second heater configured to heat and melt the first quantity of alloy; and a casing joint configured to be installed within a wellbore, the casing joint comprising a plurality of alloy ports carrying the second quantity of alloy.

2. The well tool assembly of claim 1, wherein the first heater is configured to heat and melt the second quantity of alloy.

3. The well tool assembly of claim 2, wherein the tool body comprises a landing collar that is axially offset from the heater section, the landing collar configured to cause the heater section to reside radially adjacent the plurality of alloy ports in response to the tool body being installed within the casing joint.

4. The well tool assembly of claim 3, wherein the tool body comprises a first stop collar that is axially offset from the pressure section, the first stop collar configured to cause the heater section to travel axially until the pressure section resides radially adjacent the plurality of alloy ports after the first heater has heated and melted the second quantity of alloy.

5. The well tool assembly of claim 4, wherein the tool body comprises a second stop collar that is axially offset from the alloy section, the second stop collar configured to cause the pressure section to travel axially until the alloy section resides radially adjacent the plurality of alloy ports after the fluid has flowed through the plurality of pressure ports radially out of the tool body.

6. The well tool assembly of claim 5, wherein the casing joint defines a seat configured to receive the landing collar when the tool body is installed within the casing joint.

7. The well tool assembly of claim 1, further comprising an activation dart configured to be dropped into the tool body, the activation dart configured to land in a seat adjacent the heater section and to turn on the first heater.

8. The well tool assembly of claim 7, wherein the tool body defines circulation ports on the circumferential surface of the tool body between the heater section and the pressure section, wherein the activation dart closes the circulation ports and causes the fluid to flow through the plurality of pressure ports.

9. The well tool assembly of claim 7, wherein an inner profile of the pressure section substantially matches an outer profile of the activation dart, wherein the activation dart is configured to axially seal the pressure section.

10. A method comprising:

running a tool body defining an internal volume within a casing joint installed within a wellbore, the casing joint comprising a plurality of alloy ports carrying a quantity of alloy;

positioning a heater section at a first end of the tool body radially adjacent the plurality of alloy ports, the heater section carrying a first heater;

operating the first heater to heat and melt the quantity of alloy in the plurality of alloy ports exposing an annular region between an outer surface of the casing joint and an inner wall of the wellbore;

after operating the first heater to heat and melt the quantity of alloy, positioning a pressure section axially attached to the heater section radially adjacent the plurality of alloy ports, the pressure section defining a plurality of pressure ports on a circumferential surface of the tool body;

flowing, through the plurality pressure ports, fluid from the internal volume of the tool body and through the plurality of alloy ports into the annular region;

after flowing the fluid into the annular region, positioning an alloy section axially attached to the pressure section radially adjacent the plurality of alloy ports, the alloy section carrying a quantity of alloy; and heating the quantity of alloy carried by the alloy section causing the quantity of alloy to melt and flow into the annular region.

11. The method of claim 10, further comprising, when manufacturing the casing joint:

forming the plurality of alloy ports in the casing joint; and depositing the quantity of alloy in the plurality of alloy ports.

12. The method of claim 11, further comprising, when manufacturing the casing joint, forming a seat in the casing joint at a location that is axially offset from the plurality of alloy ports.

13. The method of claim 12, wherein the tool body comprises a landing collar that is axially offset from the heater section, wherein positioning the heater section at the first end of the tool body radially adjacent the plurality of alloy ports comprises running the tool body within the casing joint until the landing collar is received in the seat.

14. The method of claim 13, wherein the tool body comprises a first stop collar that is axially offset from the pressure section, wherein positioning the pressure section radially adjacent the plurality of alloy ports comprises running the tool body within the casing joint until the first stop collar abuts the landing collar.

15. The method of claim 14, wherein the tool body comprises a second stop collar that is axially offset from the alloy section, wherein positioning the alloy section radially adjacent the plurality of alloy ports comprises running the tool body within the casing joint until the second stop collar abuts the first stop collar.

16. The method of claim 10, wherein operating the first heater to heat and melt the quantity of alloy in the plurality of alloy ports comprises dropping an activation dart into the tool body, wherein the activation dart lands in a seat adjacent the heater section to turn on the first heater.

17. The method of claim 16, wherein, in response to being dropped into the tool body, the activation dart closes circulation ports defined on the circumferential surface of the tool body between the heater section and the pressure section, and wherein, in response to the activation dart closing the circulation ports, the fluid flows through the plurality of pressure ports.

18. The method of claim 10, wherein the quantity of alloy, after melting and flowing into the annular region, solidifies, wherein the method comprises, after the quantity of alloy solidifies:

withdrawing the tool body from within the wellbore; and drilling out a portion of the solidified quantity of alloy to access downhole regions within the wellbore.

19. A method of treating cement in a casing-to-casing annulus, the method comprising:

installing a casing joint within a wellbore, the casing joint comprising a plurality of alloy ports carrying a quantity of alloy;

cementing an annular region between an outer surface of the casing joint and an inner wall of the wellbore, wherein cement used in the cementing occupies a portion of the annular region adjacent the plurality of alloy ports;

detecting a crack in the cement in the portion of the annular region adjacent the plurality of ports;

in response to detecting the crack in the cement, treating the cement by:

running a tool body defining an internal volume within the casing joint;

positioning a heater section at a first end of the tool body radially adjacent the plurality of alloy ports, the heater section carrying a first heater;

operating the first heater to heat and melt the quantity of alloy in the plurality of alloy ports exposing an annular region between an outer surface of the casing joint and an inner wall of the wellbore;

after operating the first heater to heat and melt the quantity of alloy, positioning a pressure section axially attached to the heater section radially adjacent the plurality of alloy ports, the pressure section defining a plurality of pressure ports on a circumferential surface of the tool body;

flowing, through the plurality pressure ports, fluid from the internal volume of the tool body and through the plurality of alloy ports into the annular region;

after flowing the fluid into the annular region, positioning an alloy section axially attached to the pressure section radially adjacent the plurality of alloy ports, the alloy section carrying a quantity of alloy; and heating the quantity of alloy carried by the alloy section causing the quantity of alloy to melt and flow into the annular region.

20. The method of claim 19, wherein the quantity of alloy, after melting and flowing into the annular region, solidifies, wherein the method comprises, after the quantity of alloy solidifies:

withdrawing the tool body from within the wellbore; and drilling out a portion of the solidified quantity of alloy to access downhole regions within the wellbore.

* * * * *